US005384852A

United States Patent [19]

Schären

[11] Patent Number: 5,384,852

[45] Date of Patent: Jan. 24, 1995

[54] HEARING AID HAVING A PROGRAMMABLE AUDIO INPUT

[75] Inventor: Beat Schären, Iffwil, Switzerland

[73] Assignee: Ascom Audiosys AG, Switzerland

[21] Appl. No.: 104,402

[22] Filed: Aug. 10, 1993

Related U.S. Application Data

[63] Continuation of Ser. No. 595,416, Oct. 11, 1990, abandoned.

[30] Foreign Application Priority Data

Nov. 29, 1989 [CH] Switzerland ..... 4275/89

[51] Int. Cl.[6] ..... H04R 25/00

[52] U.S. Cl. ..... 381/68; 381/68.2; 381/68.4

[58] Field of Search ..... 381/68, 68.2, 68.4, 381/60

[56] References Cited

U.S. PATENT DOCUMENTS

| | | | |
|---|---|---|---|
| 4,425,481 | 1/1984 | Mangold et al. | 381/68 |
| 4,622,440 | 11/1986 | Slavin | 381/68 |
| 4,689,819 | 8/1989 | Killion | 381/68 |
| 4,879,749 | 11/1989 | Levitt et al. | 381/68 |
| 4,901,353 | 2/1990 | Widin | 381/68 |
| 4,972,487 | 11/1990 | Mangold et al. | 381/68 |
| 4,992,966 | 2/1991 | Widin et al. | 381/68 |

*Primary Examiner*—Chris Kuntz
*Assistant Examiner*—Jason Chan
*Attorney, Agent, or Firm*—Nies, Kurz, Bergert & Tamburro

[57] ABSTRACT

The programming contacts of a programmable hearing aid are selectively used as audio input. To this end an electronic switch is provided which is controlled by the memory block. By transmitting special data signals to the memory block the switch is switched on or off, respectively.

3 Claims, 1 Drawing Sheet

HEARING AID HAVING A PROGRAMMABLE AUDIO INPUT

This application is a continuation, of application Ser. No. 07/595,416, filed Oct. 11, 1990, now abandoned.

BACKGROUND OF THE INVENTION

1. Field of the Invention

The present invention relates to a digitally programmable hearing aid having a sound amplifier and a digital memory block including memory contacts.

2. Description of the Prior Art

Such hearing aids which amplify the sound received via a microphone in order to render same hearable by a person suffering from certain losses of hearing are generally known. Also known are such hearing aids which are specially adjustable to the individual needs of the wearer of the hearing aid by means of external programming apparatus adapted to be connected to the hearing aid. The connecting of such programming apparatus is by programming contacts mounted on the hearing aid which as a rule are designed bipolar.

SUMMARY OF THE INVENTION

A general object of the invention is to allow the connection of electrical signals of arbitrary external sources of sound directly to the sound signal amplifier, i.e. to realize a so called audio-input. Such inputs comprise as is generally known two to three electrical contacts which are mounted at the hearing aid at a suitable location in order to be contacted by a corresponding counter piece. These additional contacts require space and thus limit the possible degree of miniaturization of such as hearing aids is specifically demanded for cosmetic or aesthetic reasons.

A further object is to provide an electronic switch arranged to selectively connect and disconnect, respectively, at least one pole of the programming contacts to or from at least one input of the sound signal amplifier and which is connected itself via a control line to a digital memory block.

Yet a further object is to provide a hearing aid in which the electronic switch comprises an arrangement of field effect transistors.

Specifically advantageous is the fact that no additional space is required in the hearing aid for the audio input, but that rather the programming contacts present in programmable hearing aids are utilized. After the programming procedure during which the properties of the sound amplifications are set the closing of the electronic switch is effected by means of a specific data word by means of which all electrical signals which are thereafter connected to these contacts reach the input of the sound signal amplifier. The space requirements of an electronic switch are much smaller than those for a plug contact because the switch can be integrated into the electronic circuit (integrated circuit) of the hearing aid.

In order to avoid disturbing noises by transmission of the digital data signals to the sound signal amplifier upon a new programming of the hearing aid, firstly again a specific digital data signal is transmitted which causes an opening of the electronic switch. Since the data signals have a many times higher voltage (about 1 V) than the audio signals (about 1 mV) it is not possible to misinterpret the audio signals as data signals.

BRIEF DESCRIPTION OF THE DRAWING

The invention will be better understood and objects other than those set forth above will become apparent when consideration is given to the following detailed description thereof. Such description makes reference to the annexed drawing wherein.

DESCRIPTION OF THE PREFERRED EMBODIMENT

Figure 1:
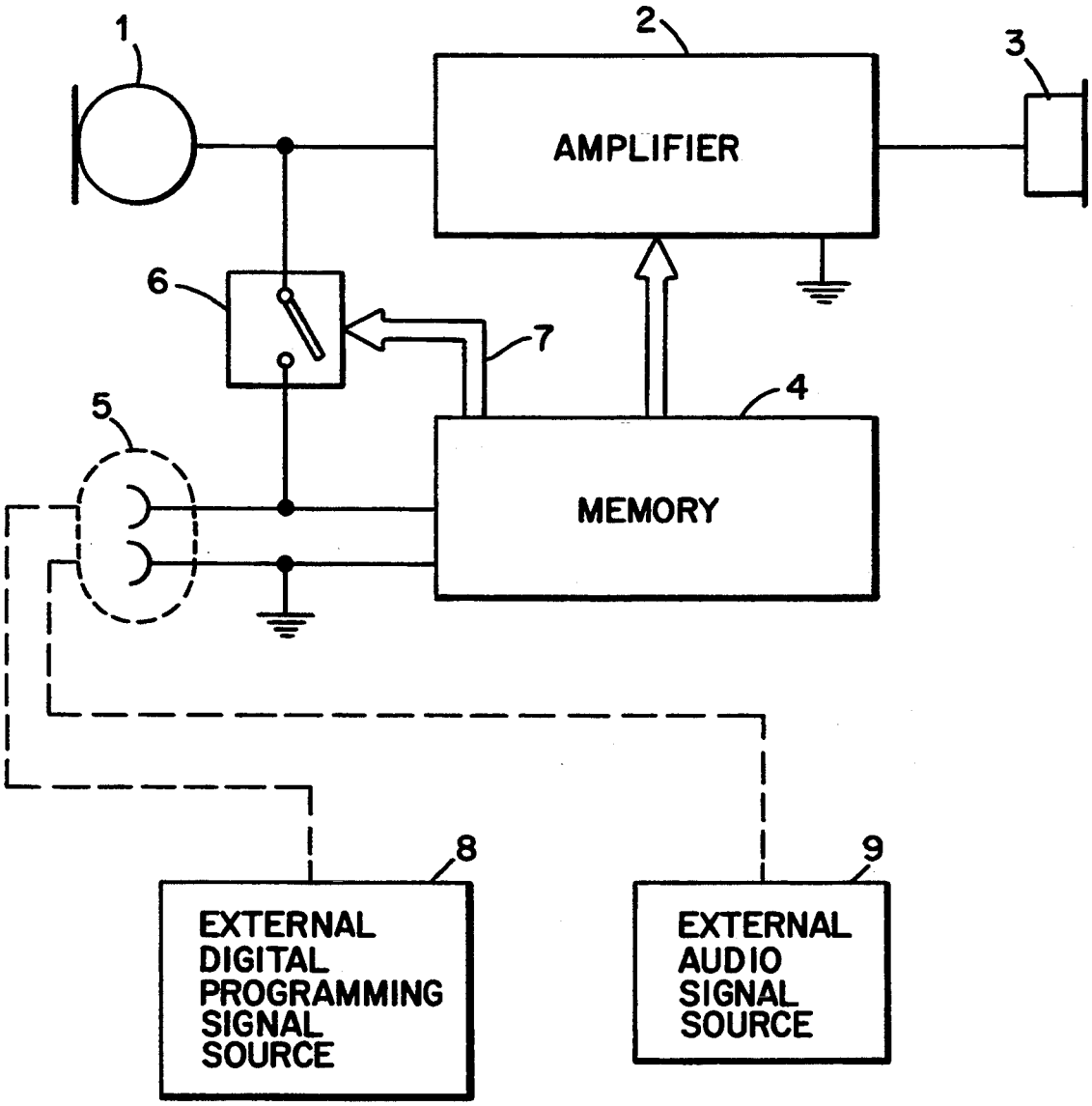
FIG. 1 is a schematic circuit diagram of a hearing aid structured in accordance with the present invention.

A programmable hearing aid includes a microphone 1 which is connected to the input of the sound signal amplifier 2. The output of the sound signal amplifier 2 is connected to a reproduction loudspeaker speaker 3.

The amplification and the sound can be adjusted by a digitally programmable nontransient memory block 4. To this end the hearing aid is connected to an external programming apparatus 8 via a double pole plug socket 5. The data which correspond to the desired setting of the hearing aid are now transmitted into the digital memory block 4 which controls the properties of the sound signal amplifier 2.

During this procedure the hearing aid is usually carried by the person with a deficient hearing, at or in the ear, in order to judge immediately the correctness of the settings.

An electronic switch 6 connects now a line of the plug socket 5 to the input line to the sound signal amplifier 2. This connection can now be closed or opened via the connecting line 7 which connects the switch 6 to the memory block 4, by means of which signals from an external audio signal source 9 applied to the plug socket 5 can reach the reproduction loudspeaker 3 amplified via the sound amplifier 2. The electronic switch 6 is for instance designed as field effect-transistor.

While there is shown and described a present preferred embodiment of the invention, it is to be distinctly understood that the invention is not limited thereto, but may be otherwise variously embodied and practiced within the scope of the following claims.

I claim:

1. In a digitally programmable hearing aid including a microphone for receiving external sounds and including a reproduction loudspeaker for reproducing the received external sounds, an audio amplifier having an input coupled with the microphone for receiving and amplifying sound signals from the microphone and having an output coupled with the reproduction loudspeaker, and a digitally programmable memory coupled with the audio amplifier for adjusting the operation of the audio amplifier and the sounds reproduced by the reproduction loudspeaker, the improvement comprising:

a unitary, bipolar input socket coupled with the digitally programmed memory for receiving digital programming signals from an external digital programming signal source and for receiving audio signals from an external audio signal source, wherein the digital programming signals are operable to adjust operation of the hearing aid for a particular user;

a first connecting line extending from at least one pole of the unitary input socket to the audio amplifier input for conducting to the audio amplifier input signals applied to the unitary input socket;

a unitary electronic switch positioned in the first connecting line between the at least one pole of the input socket and the audio amplifier input and operatively coupled with the digitally programmable memory to respond to switch position control signals provided by the digitally programmable memory to selectively operate the electronic switch between a closed position to permit the passage of signals from the input socket to the audio amplifier input through the electronic switch and an open position to prevent the passage of signals from the input socket to the audio amplifier input through the electronic switch;

a second connecting line extending between the electronic switch and the digitally programmable memory for transmitting switch position control signals from the memory to the switch;

wherein the digitally programmable memory is responsive to a first external data signal applied to the unitary input socket to provide a first switch control signal from the digitally programmable memory to the unitary electronic switch to open the switch so that an external digital programming signal applied to the unitary input socket is not received at the input of the audio amplifier and is not reproduced by the reproduction loudspeaker; and wherein the digitally programmable memory is responsive to a second external data signal applied to the unitary input socket to provide a second switch control signal from the digitally programmable memory to the unitary electronic switch to close the switch so that an external audio signal applied to the unitary input socket is received at the input of the audio amplifier and is reproduced by the reproduction loudspeaker.

2. A digitally programmable hearing aid according to claim 1 wherein the unitary electronic switch is a field effect transistor.

3. A digitally programmable hearing aid according to claim 2 wherein the external digital programming signal has a voltage of about 1 v. and the external audio signal has a voltage of about 1 mv.

* * * * *